United States Patent [19]

Bradley et al.

[11] 4,021,693

[45] May 3, 1977

[54] ELECTRON-OPTICAL IMAGE TUBE

[76] Inventors: Daniel Joseph Bradley, 73 Lambton Road, Wimbledon, London SW20; Wilson Sibbett, 43 Dundonald Road, Kensal Green, London NW10, both of England

[22] Filed: June 9, 1975

[21] Appl. No.: 584,968

[30] Foreign Application Priority Data

June 7, 1974 United Kingdom ..... 25357/74

[52] U.S. Cl. ..... 313/99; 250/213 VT

[51] Int. Cl.[2] ..... H01J 39/04; H01J 39/00

[58] Field of Search ..... 313/99, 94, 102

[56] References Cited

UNITED STATES PATENTS 3,109,957 11/1963 McGee et al. ..... 313/102 X 3,439,222 4/1969 Driard et al. ..... 313/94 X 3,761,614 9/1973 Bradley ..... 313/94 X

*Primary Examiner*—Robert Segal

*Attorney, Agent, or Firm*—Young & Thompson

[57] ABSTRACT

An electron-optical image tube including a photocathode, an extraction electrode consisting of a mesh on the emission side of the photocathode, and a focussing electrode on the side of the mesh remote from the photocathode, achieves increased time resolution, improved spatial resolution, and reduced magnification at a phosphor screen by making the photocathode to mesh spacing small compared with the mesh to focussing electrode spacing. An improved photocathode plate avoids large electric fields at sharp points on the photocathode surface. Additional annular electrodes and flared deflector electrodes in the drift section of the tube prevent scattering of electrons from the tube walls on to the screen.

5 Claims, 7 Drawing Figures

Figure 1:
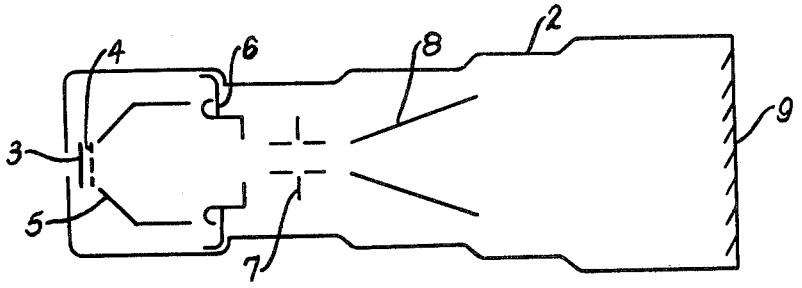
Fig. 1 (PRIOR ART)

CONE VOLTAGE
880
860
840
820
800
MESH VOLTAGE
500
600
700
800
900
1000

SPATIAL RESOLUTION lp/mm
19
18
17
16
15
14
MESH VOLTAGE
500
600
700
800
900
1000

ELECTRON-OPTICAL IMAGE TUBE

This invention relates to electron-optical streaking image tubes and to image tube streak cameras.

In U.S. Pat. No. 3,761,614 there is described an electron-optical streaking image tube which is capable of providing direct measurement of shapes and durations of picosecond pulses and which has a time resolution in the picosecond range.

This is achieved in accordance with that invention by a streaking image tube system comprising a streaking image tube with a photocathode for receiving light images of picosecond duration and converting them to photoelectrons, an extraction electrode consisting of a mesh immediately adjacent to the emission side of the photocathode, a source of positive voltage connected to said mesh to maintain the mesh at a constant positive potential with respect to the photocathode to accelerate the photoelectrons away from the photocathode, a screen for receiving the photoelectrons, and deflection electrode means on the path of the photoelectrons between the mesh ad the screen for periodically deflecting said photoelectrons normally to their direction of movement after acceleration thereof, the magnitude of the voltage difference between the photocathode and the mesh and the separation of the photocathode and the mesh being such that the photoelectrons are positively accelerated away from the photocathode at such values that a time resolution in the picosecond range is obtainable in the streak image produced at the screen.

As shown and described in the aforesaid patent specification the image tube included a conical focusing electrode between the extraction mesh and the anode. In a typical electrode arrangement of the image tube of that earlier invention the following electrode parameters and performance characteristics are typical of those which can be achieved:

| | | |
|---|---|---|
| Photocathode-mesh separation = 3 mm | | |
| Mesh-cone separation = 3 mm | | |
| Applied Voltages | Photocathode | 150V |
| | Mesh | 2kV |
| | Cone | OV |
| | Anode/Phosphor screen | 18kV |
| Performance Characteristics | | |
| Spatial resolution at phosphor | | 8 lp/mm (line pairs/mm) |
| Electron-optical magnification | | × 3.6 |
| Spatial resolution at photocathode | | 29 lp/mm |
| Deflection sensitivity | | 330V $cm^{-1}$ |
| Extraction field strength near to photocathode (gives a time dispersion limit of 2 psec for an S1 photocathode and a 1.06 $\mu$ light pulse) | | 6.6 kV $cm^{-1}$ |

The present invention is concerned with improvements in the type of image tube described in the aforesaid patent specification and it is an object of the present invention to provide an image tube which has improved performance in a number of respects.

It should be remembered that in the design of image tubes of this nature one wishes to obtain as high a degree of time resolution and spatial resolution as possible, while keeping the electron-optical magnification from the photocathode to the phosphor screen relatively small. The time resolution is limited by the dispersion of the electrons in transit from the photocathode to the phosphor screen. Increasing the extraction field strength near to the photocathode reduces the electron dispersion but in, for example, the image tube described in my aforesaid patent specification such an increase in field strength gives rise to serious disadvantages. Thus, an increase in the voltage applied to the mesh of beyond 2kV would not only increase the electron-optical magnification (resulting in a loss of spatial resolution at the phosphor screen, and the need for both a corresponding increase in the streaking speed to maintain time resolution and an increase in image intensification to maintain detection of the image) but would also give rise to electrical discharges within the tube.

Broadly in accordance with one aspect of the present invention, there is provided an image tube comprising a photocathode, an extraction electrode consisting of a mesh on the emission side of the photocathode, and a focusing electrode on the side of the mesh remote from the photocathode, the electrode arrangement being such that the distance between the photocathode and the mesh is relatively small compared with the distance between the mesh and the focusing electrode.

Preferably, the distance between the mesh and the focusing elecrode is of the order of tens of times the distance between the photocathode and the mesh. In one particular preferred embodiment it has been found that a photocathode/mesh spacing of 0.5 mm and a mesh/focusing electrode spacing of 30 mm can be used to give particularly favourable results.

This reduction of the mesh/photocathode separation and the increase in the mesh/focusing electrode separation, as compared with the image tube of the aforesaid patent specification, thus increasing the focal length of the mesh/focusing electrode electrostatic lens, has a number of advantages as will be discussed in more detail later, among these being increased time resolution, improved spatial resolution, reduced magnification, and the ability to gate the electronic image on and off by a smaller value voltage pulse.

Figure 2:
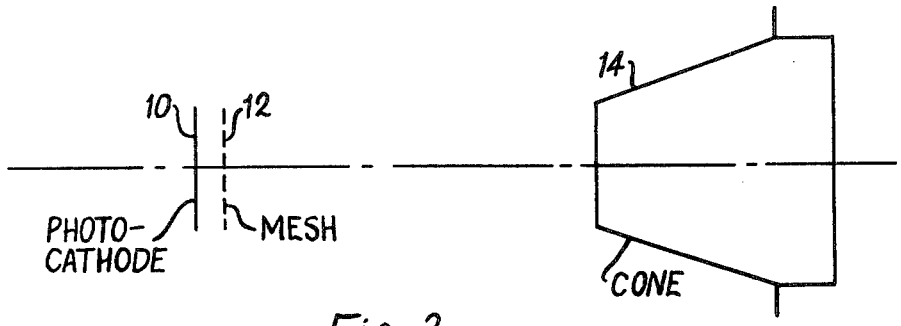
Figure 3A:
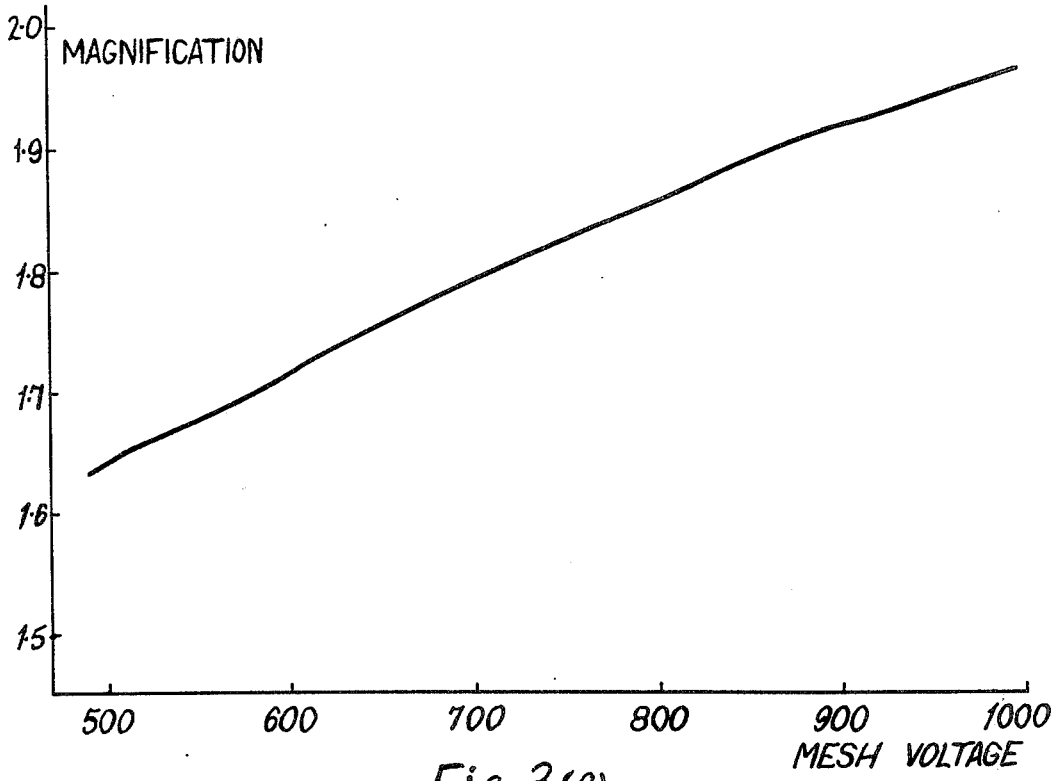
Figure 3B:
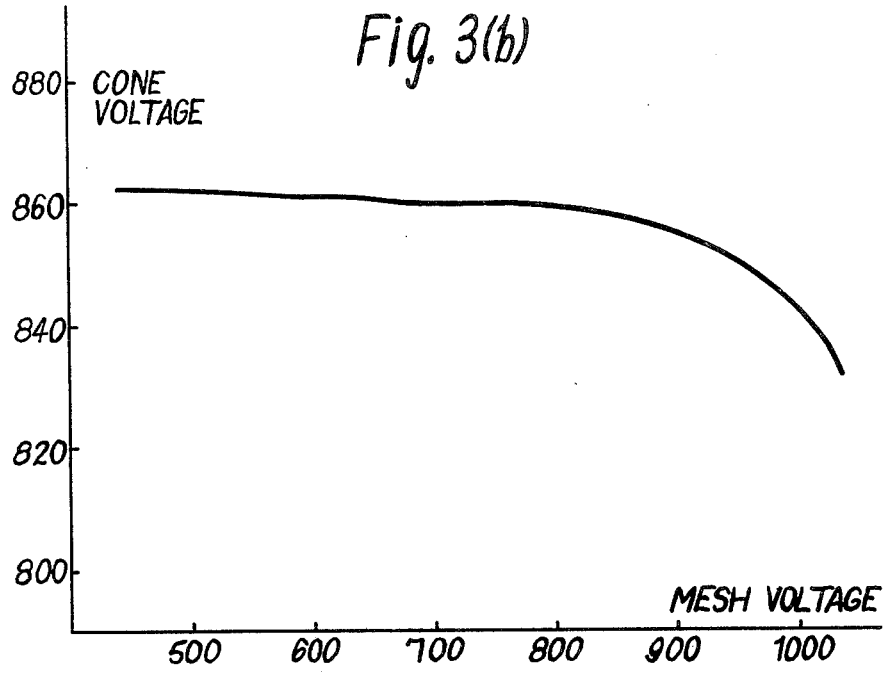
Figure 3C:
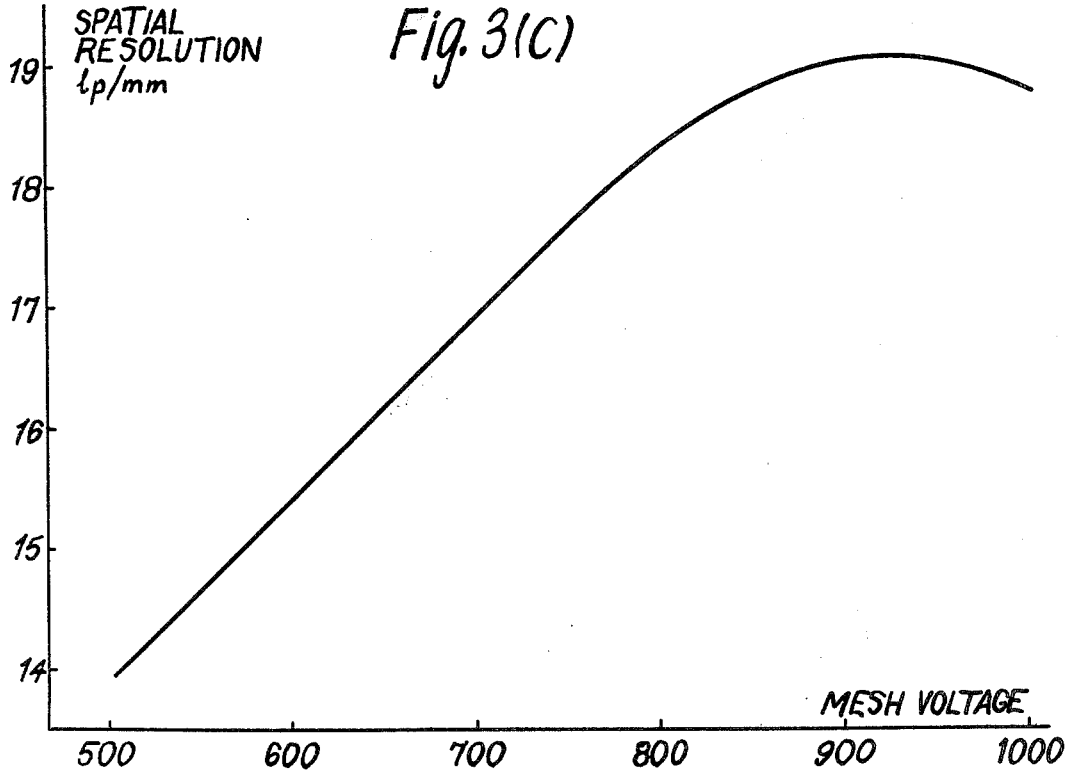
Figure 4:
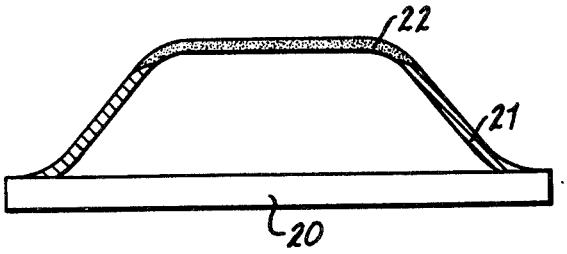
Figure 5:
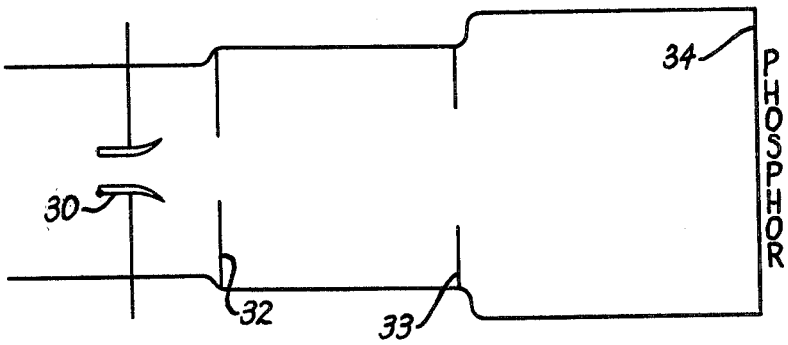

In order that the invention may be more readily understood, various features in accordance therewith will now be described by way of example and with reference to the accompanying drawings, in which:

FIG. 1 is a schematic diagram of the prior art image tube of U.S. Pat. No. 3,761,614;

FIG. 2 is a schematic illustration of the modified electrode arrangement of a part of the image tube of the present invention;

FIGS. 3(*a*), (*b*) and (*c*) are graphical representations of parameters of the image tube of the present invention;

FIG. 4 shows an improved design of photocathode plate for use in the image tube of the present invention; and, FIG. 5 shows modified deflection plates for use in the image tube of the present invention.

FIG. 1 shows the image tube 2 of the aforesaid earlier patent specification. The image tube comprises a photocathode 3 upon which light pulses of slit or substantially slit form or point-form are focussed. An extraction electrode 4 in the form of a fine metallic mesh is spaced adjacent to the photocathode 3 to generate a strong electric field and accelerate the electrons away from the photocathode. Following the extraction electrode 4 is a conical focussing electrode 5, an anode 6, shutter electrodes 7, and deflector plates or streak electrodes 8. The deflected photoelectrons then impinge on a phosphor screen 9 to produce a luminous streak image.

As mentioned above, in an image tube for use in providing direct measurement of luminous events having durations as short as one picosecond or less and with a time resolution in the picosecond and sub-picosecond range, it is desirable to increase the extraction field strength near to the photocathode, provided that one can overcome the other disadvantages which have heretofore been encountered in prior tubes when the field strength has been increased. In accordance with the present invention, the extraction field strength is increased by a rearrangement of the electrodes in the image tube as compared with conventional tubes, such as the tube shown in FIG. 1. As shown in FIG. 2, the image tube includes a photocathode 10 for receiving light images and converting them into photoelectrons, an extraction electrode 12 consisting of a metallic mesh on the emission side of the photocathode, and a focussing electrode 14 which is of generally conical shape and which focusses the electrons which are accelerated by the mesh 12 in order that they shall be able to pass through an aperture in the anode of the image tube and thence eventually to a phosphor screen.

In accordance with the present invention the focal length of the electrostatic lens formed by the mesh 12 and the cone 14 is increased as compared with conventional image tubes and the separation of the photocathode 10 and mesh 12 is reduced as compared with conventional image tubes. As compared with the image tube of the aforesaid patent specification where the photocathode-mesh separation and the mesh-cone separation are of substantially the same magnitude, in the arrangement of the present invention the mesh-cone separation is tens of times greater, preferably of the order of 60 times greater, than the photocathode-mesh separation.

In one presently preferred embodiment of the present invention which has proved in practice to produce particularly good results the mesh-cone separation is about 30 mm, and the mesh-photocathode separation is about 0.5 mm. With this arrangement and by applying a voltage of 1 kV to the mesh 12 the extraction field at the photocathode 10 is thereby increased by a factor of three to a figure of 20 kV per cm as compared with my aforesaid earlier image tube. With the following voltages applied to the electrodes:

| | |
|---|---|
| Photocathode | O V |
| Mesh | 1 kV |
| Cone | 845 V |

-continued

| | |
|---|---|
| Anode/phosphor | 18 kV |

the electron-optical magnification from the photocathode optical image to the phosphor screen image is 1.95, (i.e. a reduction by a factor of about 2 as compared wth my earlier image tube). This reduced mesh-photocathode separation and increase in the focal length of the electrostatic lens means that an increase in the cathode field of ×3, and a consequent reduction of time dispersion of ×3, requires a mesh potential of only 1 kV. In other words, the extraction field has been increased by a factor of three while the electrical potential applied to the mesh has been reduced by a factor of two. This increase in the time resolution by a factor of three truly permits sub-picosecond time resolution to be achieved.

As will be appreciated, with this arrangement a gating on pulse of 1 kV applied to the mesh electrode 12 permits the gating on and off of the electronic image.

Such a gating pulse is readily obtainable from conventional avalanche-transistor electrical circuits. The reduced mesh-photocathode distance has also reduced the mesh potential by a factor of six and thus for the same value of electric field obtained in my aforesaid earlier image tube only a voltage of about 330 V would here be needed for gating on and off the image.

With the image tube arrangement of the present invention and with the electric potentials described above, the observed spatial resolution at the phosphor screen has been measured to be 18 lp per mm. This improved spatial resolution has been obtained by the redesigned electrostatic lens of the present invention. The magnification of the image tube of the present invention can be varied by altering the mesh voltage, and the spatial resolution can be maintained by changing the voltage of the cone 14 correspondingly. FIG. 3(*a*) is a graphical plot of the magnification at the phosphor screen against variations in mesh voltage. FIG. 3(*b*) is a graphical plot of the cone voltage against the mesh voltage. FIG. 3(*c*) is a plot of the spatial resolution at the phosphor screen against variations in mesh voltage. It is also pointed out that the reduced magnification resulting from the image tube of the present invention leads to increased speed of recording and, ultimately, to better time resolution.

The increase in photocathode electron field strength is achieved in practice by avoiding the presence of unnecessarily large electric fields at sharp points on the surfaces of the photocathode and mesh. In order to achieve this an improved design of photocathode plate is used in the image tube of the present invention. FIG. 4 shows this plate. A substrate 20 comprising a base portion and a domed portion having a flattened surface and a smoothly rounded junction or shoulder with the base portion has the lower portion thereof covered by an electrically conductive layer 21 of metal. This layer 21 may be for example of silver, chromium, or platinum and may be deposited by evaporation, painting or some other equivalent technique. The substrate is first smoothly polished and is then uniformly coated by the conductive layer 21 up over the rounded shoulder. The cathode layer 22 of photocathode material is then deposited on the upper part of the dome of the substrate 20 to overlap the conductive layer 21 and thus provide good electrical contact and conductivity.

In the image tube of the aforesaid U.S. patent specification deflector electrodes are provided between the anode and the phosphor screen. However, photoelectrons may be scattered off the deflector electrodes and off the walls of the image tube before and after the streaking operation. The use of a square (in time) gating pulse to the mesh electrode will reduce this effect, but a modified design of deflector as will now be described is of considerably greater advantage. FIG. 5 shows the modified streak deflection plates and the use of additional means in the drift section of the image tube between the deflection plates and the phosphor screen. As shown in FIG. 5 the streak deflection plates 30 are flared outwardly at the end remote from the anode to prevent the deflected electron beam which passes through the plates from hitting the ends of the plates. The plates are parallel over the first part (approximately two thirds) of their length and then flare outwardly and taper to a point. FIG. 5 shows the plates 30 in side elevation. In plan view they are rectangular and are each held in postion by a support pin placed at their centre. Two further electrodes 32 and 33 in the form of annuli of metal foil for example are added in the drift section of the image tube to prevent the deflected electron beam from scattering off the tube walls on to the phosphor screen 34. The use of these additional apertured electrodes 32, 33 inside the drift space greatly reduces the signal-induced background effect. The number and position of these additional electrodes will vary in accordance with the dimensions of the particular tube.

Although in the description above reference has been made to certain dimensions and magnitudes, it should be understood that these are by way of example only and are not to be considered as limiting.

We claim:

1. In an electron-optical image tube comprising a photocathode arranged to receive light images and convert them to photoelectrons, an extraction electrode consisting of a mesh immediately adjacent to the emission side of the photocathode and adapted to be mantained at a positive potential with respect to the photocathode, a focussing electrode on the side of the mesh remote from the photocathode; and deflection electrode means on the path of the photoelectrons beyond the focussing electrode, the improvement that the photocathode/mesh spacing is of the order of 0.5 mm and the mesh/focussing electrode spacing is of the order of 30 mm, there being a drift section beyond said deflection electrode means, the drift section terminating in a screen for receiving the photoelectrons and including at least one annular electrode between the deflection electrode means and the screen preventing the scattering of electrons from the tube walls to the screen.

2. An image tube as claimed in claim 1, in which the photocathode comprises a plate having a base portion and a domed portion with a flattened surface, a coating of electrically conductive material on the base portion and adjacent part of the domed portion, and an overlapping coating of photocathode material on the flattened surface of the domed portion.

3. An image tube as claimed in claim 1, in which the deflection electrode means comprise two spaced plates between which the photoelectron beam passes, the plates each being flared outwardly at the end remote from the focussing electrode.

4. An image tube as claimed in claim 3, wherein the plates each taper to line thickness along their outwardly flared edge.

5. An image tube as claimed in claim 3, in which the plates are parallel over at least the first half of their length.

* * * * *